US011085596B2

(12) United States Patent
Wang

(10) Patent No.: US 11,085,596 B2
(45) Date of Patent: Aug. 10, 2021

(54) TABLE LAMP

(71) Applicant: SIGNIFY HOLDING B.V., Eindhoven (NL)

(72) Inventor: Guo Jiang Wang, Shenzhen (CN)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 16/957,342

(22) PCT Filed: Dec. 28, 2018

(86) PCT No.: PCT/EP2018/097111
§ 371 (c)(1),
(2) Date: Jun. 23, 2020

(87) PCT Pub. No.: WO2019/134892
PCT Pub. Date: Jul. 11, 2019

(65) Prior Publication Data

US 2020/0332973 A1 Oct. 22, 2020

(30) Foreign Application Priority Data

Jan. 2, 2018 (WO) ..... PCT/CN2018/070044
Feb. 8, 2018 (EP) ..... 18155785

(51) Int. Cl.
*F21S 6/00* (2006.01)
*F21V 5/04* (2006.01)
(Continued)

(52) U.S. Cl.
CPC ..... *F21S 6/003* (2013.01); *F21V 5/04* (2013.01); *F21V 7/0091* (2013.01); *F21V 23/04* (2013.01);
(Continued)

(58) Field of Classification Search
CPC . F21S 6/002; F21S 6/003; F21S 13/12; F21V 5/04; F21V 7/0091; F21V 23/04;
(Continued)

(56) References Cited

U.S. PATENT DOCUMENTS

2008/0253129 A1* 10/2008 Lin ..... F21V 5/045 362/295
2009/0161355 A1* 6/2009 Huang ..... G02B 6/0068 362/231
(Continued)

FOREIGN PATENT DOCUMENTS

CN 2895987 Y 5/2007
CN 201531828 U 7/2010
(Continued)

*Primary Examiner* — Y M. Quach Lee
(74) *Attorney, Agent, or Firm* — Daniel J. Piotrowski

(57) ABSTRACT

A table lamp comprises a base and an elongate head. The head has two elongate LED arrangements each extending along the length direction of the elongate head, each LED arrangement providing a light output pattern which is asymmetric and is generally directed to a respective lateral side of the elongate head. A beam-shaping lens structure is associated with the two LED arrangements. Each LED arrangement is independently controlled. Thus, separate LED arrangements are provided, one for left-handed use and one for right-handed use. This avoids the need for reconfiguration between left-handed and right-handed operation, and the lamp design is able to meet requirements of glare control, light uniformity, and blue light hazard control.

13 Claims, 3 Drawing Sheets

(51) Int. Cl.

| | |
|---|---|
| *F21Y 103/10* | (2016.01) |
| *F21Y 115/10* | (2016.01) |
| *F21V 7/00* | (2006.01) |
| *F21V 23/04* | (2006.01) |

(52) U.S. Cl.
CPC ..... *F21Y 2103/10* (2016.08); *F21Y 2115/10* (2016.08)

(58) Field of Classification Search
CPC ..... F21Y 2103/10; F21Y 2115/10; G02B 6/0036; G02B 6/0038; G02B 6/0068; G02B 6/0073
See application file for complete search history.

(56) References Cited

U.S. PATENT DOCUMENTS

| | | | | |
|---|---|---|---|---|
| 2016/0010815 | A1* | 1/2016 | Ji | G02B 6/0043 362/611 |
| 2016/0025316 | A1 | 1/2016 | Chien | |
| 2018/0077767 | A1* | 3/2018 | Soler | H05B 45/10 |

FOREIGN PATENT DOCUMENTS

| | | | |
|---|---|---|---|
| CN | 203979987 | U | 12/2014 |
| JP | 2013246956 | A | 12/2013 |
| WO | 2007032187 | A1 | 3/2007 |
| WO | 2017177581 | A1 | 10/2017 |

* cited by examiner

TABLE LAMP

CROSS-REFERENCE TO PRIOR APPLICATIONS

This application is the U.S. National Phase application under 35 U.S.C. § 371 of International Application No. PCT/EP2018/097111, filed on Dec. 28, 2018, which claims the benefit of International Application No. PCT/CN2018/070044, filed on Jan. 2, 2018 and European Patent Application No. 18155785.1, filed on Feb. 8, 2018. These applications are hereby incorporated by reference herein.

FIELD OF THE INVENTION

This invention relates to table lamps.

BACKGROUND OF THE INVENTION

At present, table lamps for providing illumination for visual tasks should meet requirements for low glare hazard, even light distribution and low blue light hazard at the same time. There are standards for each of these requirements.

For example, for glare control, with the user's eyes 400 mm above a work surface and 600 mm horizontally from the center of the lighting unit of the table lamp, the inner surface of a lamp reflector and the light sources should not be directly visible. It is preferable for the lighting unit to be horizontal to meet this requirement.

The light output should cover a 120 degree sector with a first area defined up to a radius of 300 mm and a second area defined from 300 mm to 500 mm radius. There are requirements on the light output in these areas such as an illuminance of at least 500 Lux in the first area. There is also a requirement for a ratio of maximum illuminance to minimum illuminance of less than 3. It is preferable for the lighting unit to have an asymmetric light output to meet this requirement.

There is also a requirement for maintaining the blue light hazard below a threshold, for example to maintain a blue light weighted radiance of less than 100 $W/(m^2 \cdot Sr)$. To meet this requirement, it is desirable to provide a large area of the light exit window of the table lamp.

Existing table lamp designs have a thick lamp head so that the light source can be recessed out of view. Furthermore, when an asymmetric light output is provided, the lamp then becomes suitable for mounting with only one orientation; it is not interchangeable between right-handed and left-handed operation. There are lamp designs in which the lamp can be manually reconfigured between left-handed and right-handed modes of operation, but this is inconvenient for the user.

Many current lamp designs are also not able to meet new blue light hazard requirements, because they have a small number of individual high power LEDs each with an associated optical element.

There is thus a need for a table lamp which achieves these aims, but with a low cost and compact optical design.

SUMMARY OF THE INVENTION

The invention is defined by the claims.

According to examples in accordance with an aspect of the invention, there is provided a table lamp, comprising:

a base;

an elongate head; and a head support extending between the base and the head, wherein the head comprises:

two elongate LED arrangements each extending along the length direction of the elongate head, each LED arrangement providing a light output pattern which is asymmetric and is generally directed to a respective lateral side of the elongate head; and beam-shaping lens structure associated with the two LED arrangements, and wherein the table lamp comprises a control input, for controlling independently each LED arrangement.

This table lamp arrangement makes use of separate LED arrangements, one for left-handed use and one for right-handed use. Each one delivers an asymmetric output, in particular asymmetric with respect to the central elongate axis of the head. Thus, when the lamp is positioned at the back of a workspace, and extending across the workspace, it delivers light forwardly to the workspace. The lens structure enables a larger number of low power LEDs to be employed. The two LED arrangements feed light into the shared head.

The control input is for example provided in the base. In this way, the lamp is simple to use. The control input for example comprises a switch for each LED arrangement. The user thus selects right-handed or left-handed operation simply by operating the suitable LED arrangement. This may simply involve using the switch closest to the user, which will depend on whether the lamp has been mounted with a right-handed orientation (with the base to the left) or with a left-handed orientation (with the base to the right).

Each LED arrangement for example comprises a linear array of LEDs. There may be a large number of LEDs for each array, for example between 20 and 100 LEDs. This enables a low local radiance at the light exit window of the lamp head, so that blue light hazard requirements can be met.

The head preferably comprises a light guiding body and each LED arrangement is mounted along a respective lateral side edge of the head to direct light into the light guiding body.

In this way, there is a shared light guiding body with two opposing lateral faces, each of which is provided with a respective LED arrangement.

By providing side-facing LED arrangements, it is possible to prevent direct view of the light sources. This also provides a compact arrangement. The distance between the light output surface and light entrance surface of the lens structure may be designed to be less than 1 mm, or even less than 0.5 mm.

The lens structure may form a top surface of the light guiding body for reflecting light towards a bottom light exit surface of the light guiding body.

This defines a structure which makes use reflection to deliver light to the bottom light exit surface. The top surface provides a continuous lens structure for both LED arrangements, rather than requiring separate optics for each LED.

The lens structure for example comprises a first set of ridges which extend in a parallel direction along the length of the head at one lateral side of the head and a second set of ridges which extend in a parallel direction along the length of the head at an opposite lateral side of the head. Different ridges for example have different general elevation angles, so that their light reflection function is optimized having regard to the relative position of the light source.

There are thus two functional units defined by the lens arrangement, one for each LED arrangement.

The ridges may comprise total internal reflection facets for reflecting light towards the bottom light exit surface. The total internal reflection facets are preferably curved to define a portion of a concave reflection surface. These curved facets thus provide a desired beam steering and beam shaping function, in order to achieve desired light output characteristics. The facets are optimized in their orientation and shape for this purpose.

The bottom surface may be planar.

In preferred designs, the head has a length of 200 mm to 400 mm, for example 250 mm to 350 mm and a width of 30 mm to 80 mm, for example 40 mm to 60 mm. This provides a compact beam type illumination bar.

The total thickness of the lamp head may be less than 8 mm providing a very compact overall volume with low weight as well as options for a pleasing aesthetic design.

The lens structure may comprise a single molded component.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1:
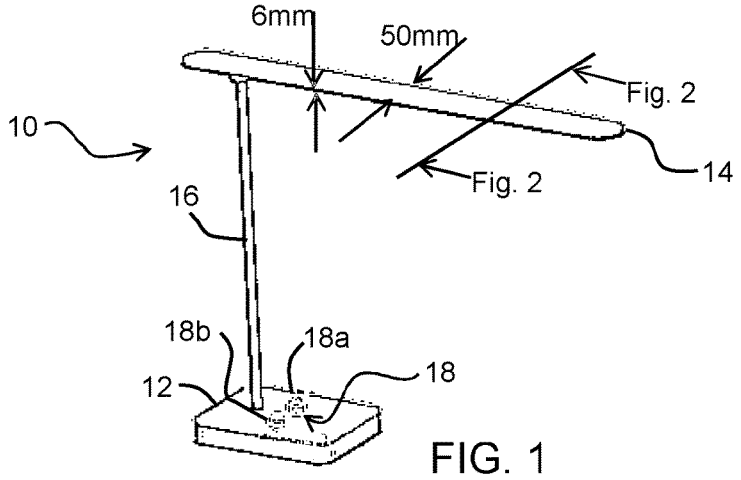
FIG. 1 shows a table lamp in accordance with an example of the invention.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a table lamp, comprising a base and an elongate head. The head has two elongate LED arrangements each extending along the length direction of the elongate head, each LED arrangement providing a light output pattern which is asymmetric and is generally directed to a respective lateral side of the elongate head. A beam-shaping lens structure is associated with the two LED arrangements. Each LED arrangement is independently controlled. Thus, separate LED arrangements are provided, one for left-handed use and one for right-handed use. This avoids the need for reconfiguration between left-handed and right-handed operation, and the lamp design is able to meet requirements of glare control, light uniformity, and blue light hazard control.

FIG. 1 shows a table lamp 10 in accordance with the invention.

The lamp comprises a base 12, an elongate head 14 and a head support 16 extending between the base and the head. The head 14 is designed to be horizontal in use, as shown, although it is equally possible for the orientation (e.g., an elevation angle) of the head to be adjustable.

The head comprises two independently controllable lighting arrangements, in particular LED arrangements. A control input 18 enables independent control of each LED arrangement. In the example shown, the control input comprises two on-off buttons 18*a*, 18*b* (optionally with brightness selection capability). The LED arrangements provide an asymmetric light output, in particular directing light generally to one side of the head 14. The lamp is intended to be positioned across and at the back of a workspace, and project light forwardly onto the workspace in use. The selection of one or other LED arrangement enables left-handed or right-handed use of the lamp.

For right-handed use, the base 12 is positioned to the left as shown in FIG. 1 to leave as much space as possible free around the right hand. For left-handed use, the base 12 is positioned to the right.

Figure 2:
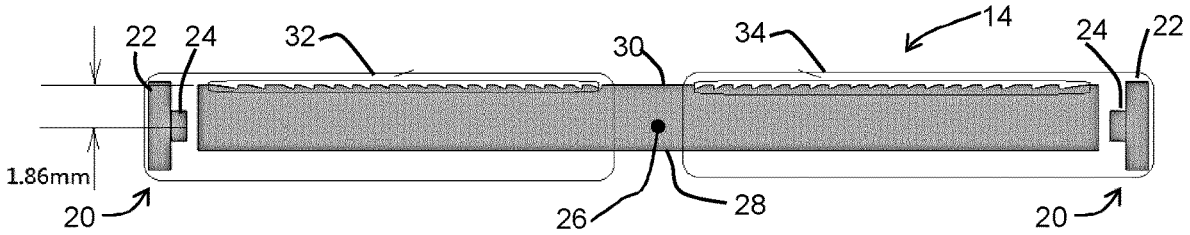
FIG. 2 shows a cross sectional view of the head, perpendicular to the length direction.

FIG. 2 shows a cross sectional view of the head 14, wherein the cross section is perpendicular to the length direction.

The head 14 comprises two elongate LED arrangements 20 each extending along the length direction of the elongate head 14. Each LED arrangement comprises a carrier 22 and a line of LEDs 24. The line of LEDs forms a linear array of LEDs. There may be a large number of LEDs for each array, for example between 20 and 100 LEDs.

The carrier is for example a printed circuit board and the LEDs are low power LEDs, for example each with a power less than 1 W, for example a power of 0.2 W. They may for example not have any optics at their output, in particular no collimation optics at the LED output.

As shown, the LEDs have a main light output direction which is horizontal (when the lamp head is horizontal), i.e. in the width direction of the lamp head. Each LED arrangement directs light inwardly towards the center of the head.

The lamp head comprises a light guiding body 26 and each LED arrangement 20 is mounted along a lateral side edge of the head to direct light into the light guiding body 26.

The lamp head has very low thickness (and therefore height). For example the height of each LED arrangement in the example shown is around 3.7 mm. The overall thickness and hence height of the lamp head is for example more generally less than 8 mm, for example in the range 5 mm to 8 mm (6 mm is shown in FIG. 1). This provides a compact arrangement. The width of the lamp head is for example approximately 50 mm (as shown in FIG. 1), for example in the range 30 mm to 80 mm, for example in the range 40 mm to 60 mm.

The distance between an LED center and the nearest point of the body 26 is only 1.1 mm in this example, and the distance between the LED light exit surface and the entrance surface of the body 26 is less than 1 mm, for example less than 0.5 mm.

The light guiding body 26 has a smooth lower light exit surface 28 and a textured upper surface 30. This upper surface 30 forms a lens structure. In particular, the textured surface 30 defines two textured zones 32, 34. One textured zone is at each lateral side of the upper surface 30 and each is associated with its nearest LED arrangement. The textured zones 32, 34 function to provide a total internal reflection of light such that the light is redirected downwardly with an angle such that the light can escape from the bottom surface 28.

Each textured zone comprises a set of ridges which extend in a generally parallel length direction which corresponds to the length axis of the head. They have facets with angles which depend on the distance from the LED arrangement. Thus, different ridges have different general facet angles. The "general" facet angle is an average angle, since the facets are curved rather than planar, as discussed further below. The design of the facets is such as to achieve a desired light output pattern when the respective LED arrangement is turned on.

The top surface in this way provides a continuous lens structure for both LED arrangements, and this simplifies the arrangement.

Figure 3:
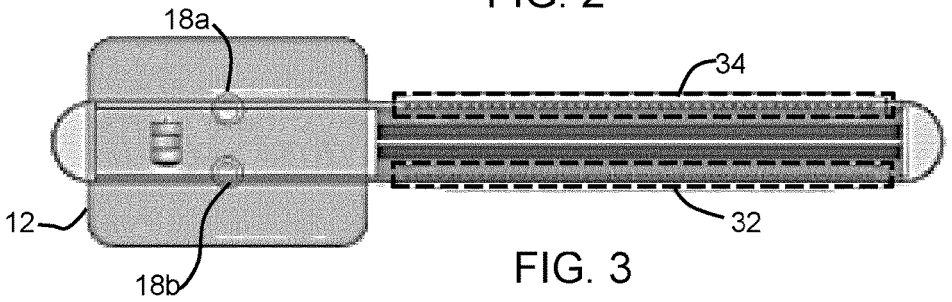
FIG. 3 shows the lamp from above.
Figure 4:
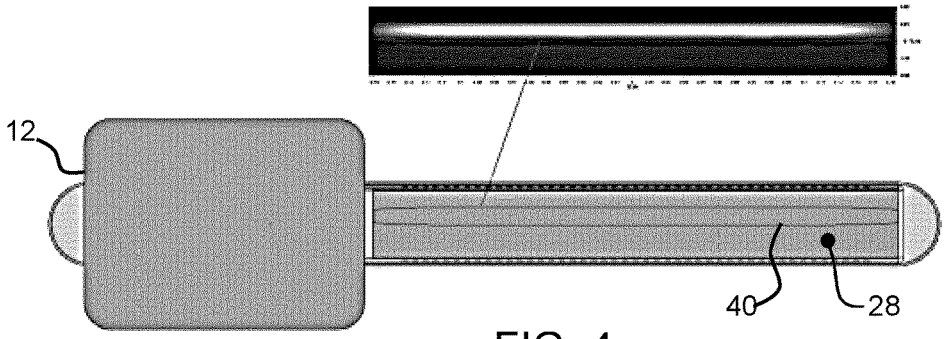
FIG. 4 shows the lamp from below.

FIG. 3 shows the lamp from above, and FIG. 4 shows the lamp from below.

The shape of the textured zones 32, 34 in plan view can be seen in FIG. 3, at the top surface of the lamp head. They may be visible or they may be covered if a different aesthetic appearance is desired.

The light may be controlled to exit the lower surface through total internal reflection alone. However, additional measures may be taken to increase the light efficiency. First, a specular reflecting coating may be provided over the top surface. Second, a high reflective separate sheet may be provided over the top of the head. Third, the head may have an outer housing, and a highly reflective powder coating may be provided in the inner top surface of the head just above the top of the lens structure.

FIG. 4 shows the area 40 from which light is emitted from the bottom surface when one of the LED arrangements is turned on. It also shows a representation of the light output pattern at the light exit window, which comprises a band of relatively uniform brightness. It has been found that this light pattern can meet the blue light hazard requirements for the maximum blue weighted radiance.

Figure 5:
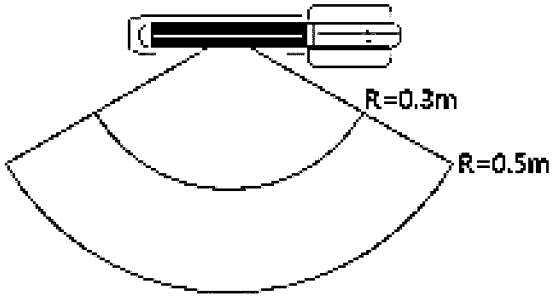
FIG. 5 shows the general intended light output area.

The light output is provided in a lateral direction as mentioned above. FIG. 5 shows the general intended light output area. There is a main target light output area formed of a sector of a circle with radius 0.3 m and angle 120 degrees, and a secondary target area formed of the same 120 degree sector but with radius from 0.3 m to 0.5 m.

Figure 6:
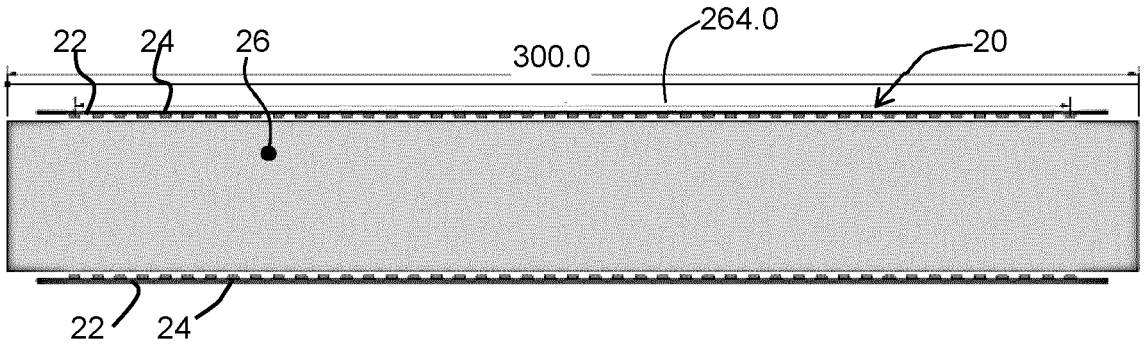
FIG. 6 shows in enlarged form the part of the head which extends beyond the base.

FIG. 6 shows in enlarged form the part of the head which extends beyond the base so that the LED arrangements may be seen more clearly. In particular, the individual LEDs 24 can be seen. There is a line of 45 LEDs in this example, with a pitch of 6 mm. The corresponding length of the LED array is shown in this example to be 264 mm and the overall length of overhang of the head is 300 mm. Thus, light is output along substantially the full length of the head. More generally, the head for example has an overhang length in the range 200 mm to 400 mm, for example 250 mm to 350 mm.

By providing a large number of LEDs along the length of the lamp head, the radiance distribution area is increased by using many low power LEDs, and this assists in meeting the blue light hazard requirements.

Figure 7:
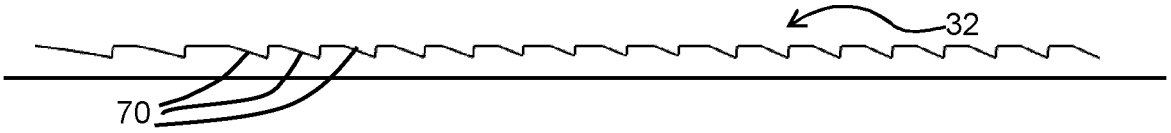
FIG. 7 shows an example of the shape of one textured zone more clearly.

FIG. 7 shows an example of the shape of one textured zone 32 more clearly and shows that there is a set of facets 70. These become progressively steeper (i.e. more vertical) at increasing distance from the light source (which will be positioned to the left in FIG. 7). The facet design increases the radiance distribution area on the lamp head exit window to reduce the local radiance, as well as enabling a thin head design.

Figure 8:
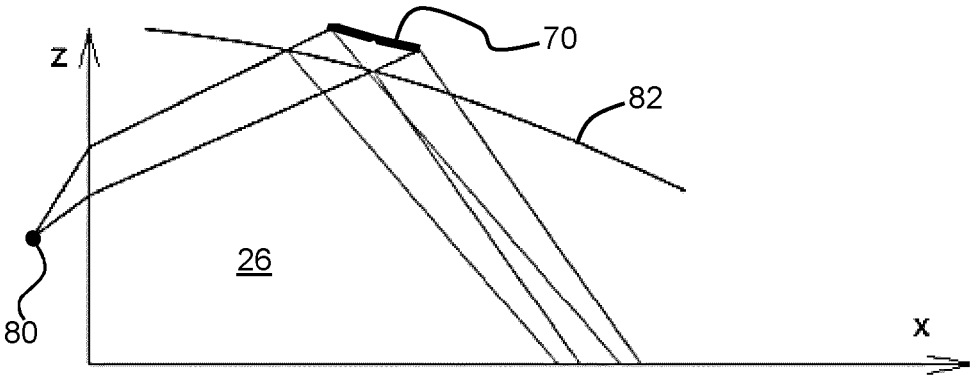
FIG. 8 shows how each facet may be designed by optical modeling.

FIG. 8 shows how each facet 70 may be designed by optical modeling.

FIG. 8 represents the light source as a point at location 80. The distance between the light output surface of the light source, at location 80, and a light entrance surface of the lens structure is preferably be less than 1 mm, for example less than 0.5 mm. This light entrance surface is represented by the z axis in FIG. 8, and the x axis represents the width direction of the head.

There is refraction when the light enters the light guiding material 26 and reflection at the facet 70. The facet 70 is basically a portion of a desired total internal reflection curve 82. The textured surface functions as a flattened version of the curve 82 by dividing the curve 82 into a set of facets. However, each facet has the same light distribution angles as the corresponding part of the original curve.

The facets are thus curved (in the cross section perpendicular to their length axis, i.e. perpendicular to the length of the head). As shown in FIG. 8, this means that the light which is reflected from opposite ends of each facet (in the cross section mentioned above) converges. For this purpose, the surface functions as a portion of a concave mirror. The general angle of each facet and the curvature define the beam shaping and directing function of each facet, and in combination these define the optical function of the lens structure as a whole.

When the portions of the facets which are in the line of sight from the light source location are combined, they may together define a continuously curved surface, with no discontinuities, i.e. the curve 82. In other words, the facets 70 comprise translated portions of a continuous smooth concave mirror curve 82. These portions are translated along the direction of light incidence from the light source location 80 (i.e. after the refraction angle change as shown in FIG. 8).

The direct light rays from the light source location 80 also preferably all reach a facet 70, so that there are not regions between the facets which receive direct incident light.

As shown in FIG. 7, the angles of the other edges (i.e. those portions which are not in the line of sight from the light source location) are less important, and they may instead have a flat top (parallel to the planar bottom surface) and vertical connecting ridges. The connecting ridges may of course equally have any other angle, as they are outside the line of sight from the light source location 80.

Figure 9:
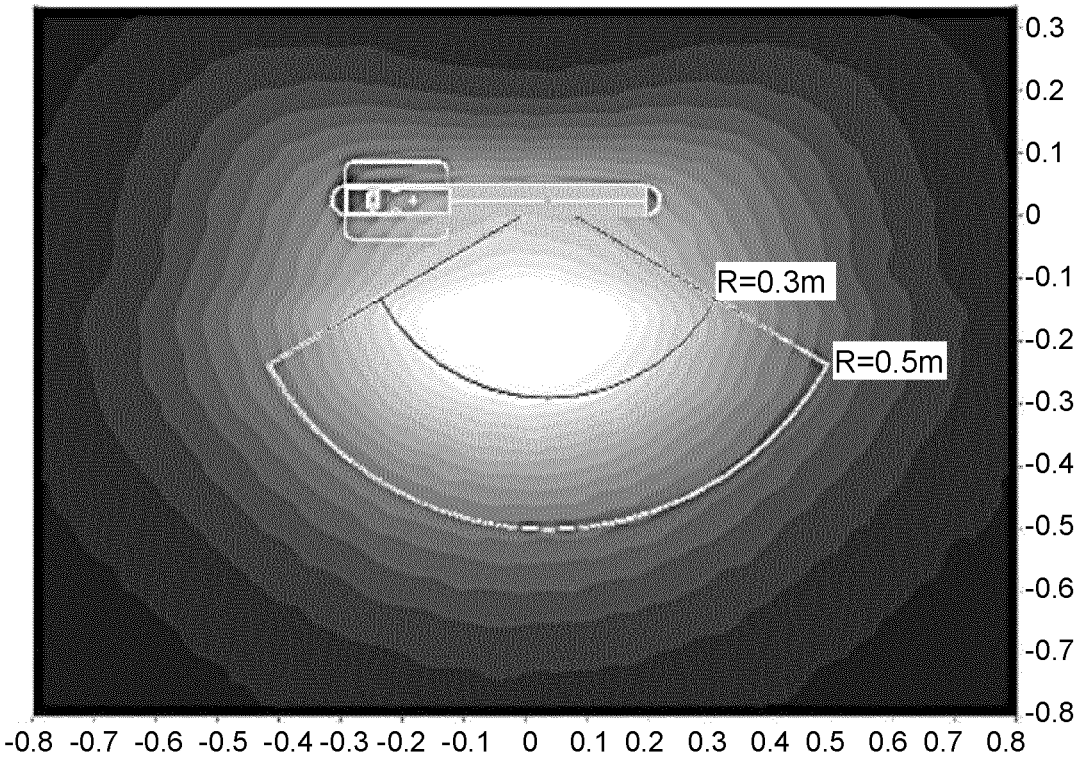
FIG. 9 shows a simulation of the light output as projected onto a horizontal surface for the right-handed configuration.
Figure 10:
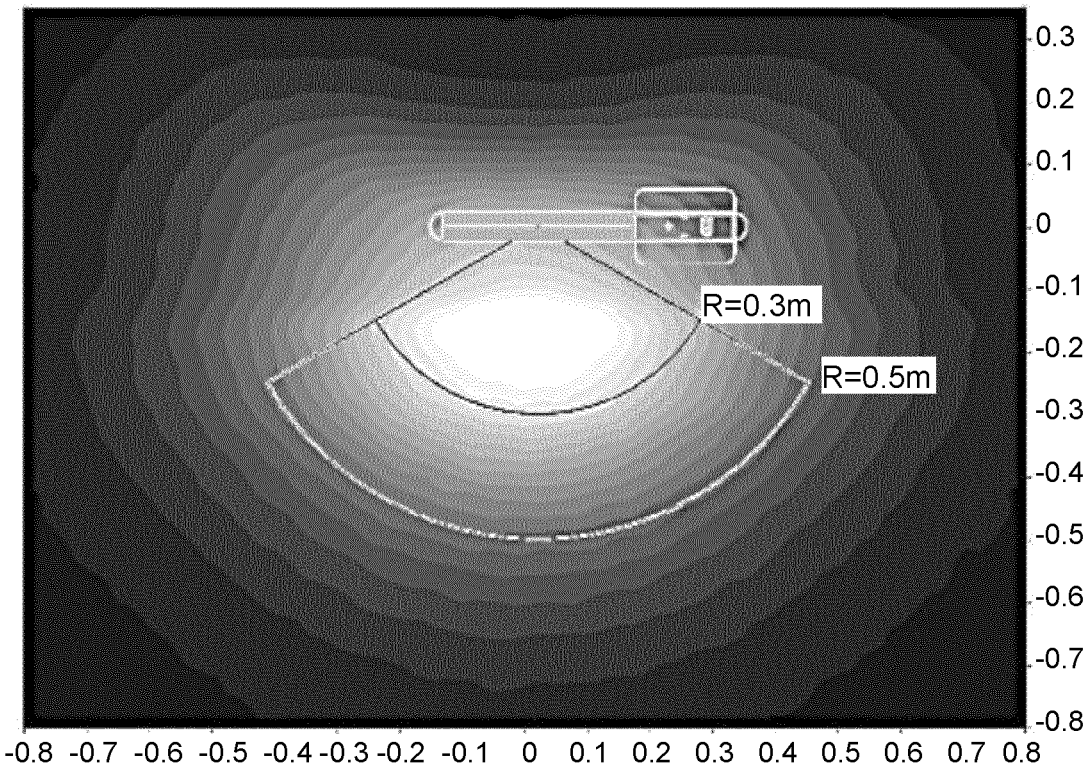
FIG. 10 shows a simulation of the light output as projected onto a horizontal surface for the left-handed configuration.

FIGS. 9 and 10 show simulations of the light output as projected onto a horizontal surface 400 mm below the lamp head. The axes show position in meters relative to a center of the lamp head projected vertically downwardly onto the surface. FIG. 9 is for the right-handed configuration and FIG. 10 is for the left-handed configuration. These simulations show that the light output can be accurately controlled to provide the desired lighting characteristics in the regions explained with reference to FIG. 5. In the main target area the ratio of maximum illuminance to minimum illuminance is approximately 1.7 and in the secondary area it is approximately 2.5 (for both left-handed and right-handed configuration). Thus, the uniformity requirements can be met.

The use of laterally facing LED arrangements, facing into a light guiding body 26, means the shielding and glare requirements can be easily met. The table lamp for example makes use of LEDs each with a luminous flux output of 22.5 Lm.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A table lamp, comprising:

a base;

an elongate head having a central elongate axis; and a head support extending between the base and the head, wherein the head comprises:

two elongate LED arrangements each extending along the length direction of the elongate head, each LED arrangement providing a light output pattern which is asymmetric with respect to the central elongate axis of the head, and is generally directed to a respective lateral side of the elongate head;

each LED arrangement comprises a linear array of LEDs;

a light guiding body and each LED arrangement is mounted along a respective lateral side edge of the head to direct light into the light guiding body; and beam-shaping lens structure associated with the two LED arrangements, wherein the lens structure comprises a first set of ridges which extend in a parallel direction along the length of the head at one lateral side of the head and a second set of ridges which extend in a parallel direction along the length of the head at an opposite lateral side of the head;

and wherein the table lamp comprises a control input, for controlling independently each LED arrangement.

2. A lamp as claimed in claim 1, wherein the control input is provided at the base.

3. A lamp as claimed in claim 1, wherein the control input comprises a switch for each LED arrangement.

4. A lamp as claimed in claim 1, wherein each LED arrangement comprises 20 to 100 LEDs.

5. A lamp as claimed in claim 1, wherein the lens structure forms a top surface of the light guiding body for reflecting light towards a bottom light exit surface of the light guiding body.

6. A lamp as claimed in claim 5, wherein the bottom surface is planar.

7. A lamp as claimed in claim 1, wherein the ridges comprise total internal reflection facets for reflecting light towards the bottom surface.

8. A lamp as claimed in claim 7, wherein the total internal reflection facets are curved to define a portion of a concave reflection surface.

9. A lamp as claimed in claim 1, wherein the head has a length of 200 mm to 400 mm, for example 250 mm to 350 mm.

10. A lamp as claimed in claim 1, wherein the head has a width of 30 mm to 80 mm, for example 40 mm to 60 mm.

11. A lamp as claimed in claim 1, wherein the total thickness of the lamp head is less than 8 mm.

12. A lamp as claimed in claim 1, wherein the lens structure comprises a single molded component.

13. A table lamp, comprising:

a base;

an elongate head having a central elongate axis; and a head support extending between the base and the head, wherein the head comprises:

two elongate LED arrangements each extending along the length direction of the elongate head, each LED arrangement providing a light output pattern which is asymmetric with respect to the central elongate axis of the head, and is generally directed to a respective lateral side of the elongate head;

each LED arrangement comprises a linear array of LEDs;

a light guiding body and each LED arrangement is mounted along a respective lateral side edge of the head to direct light into the light guiding body;

wherein the light guiding body has a smooth lower light exit surface and a textured upper surface which forms a lens structure and defines two textured zones, one textured zone proximate each lateral side of the upper surface and each zone being associated with its nearest LED arrangement;

wherein each of the textured zones function to provide a total internal reflection of light such that the light is redirected downwardly with an angle such that light exits the guiding body only from the lower surface;

and wherein the table lamp comprises a control input, for controlling independently each LED arrangement.

* * * * *